United States Patent [19]

Spanke

[11] 4,384,517

[45] May 24, 1983

[54] FULL TONNAGE STOP FOR HYDRAULIC PRESSES

[75] Inventor: Edwin A. Spanke, Oak Forest, Ill.

[73] Assignee: Gulf & Western Manufacturing Company, Southfield, Mich.

[21] Appl. No.: 267,903

[22] Filed: May 28, 1981

[51] Int. Cl.[3] ..... B30B 1/32; B30B 15/04

[52] U.S. Cl. ..... 100/214; 100/269 R; 72/456

[58] Field of Search ..... 100/269 R, 214; 72/455, 72/456; 83/701, 859

[56] References Cited

U.S. PATENT DOCUMENTS

| | | | |
|---|---|---|---|
| 247,385 | 9/1881 | McGowan | 100/269 |
| 429,666 | 6/1890 | Webb | 100/269 R |
| 735,368 | 8/1903 | Hanna | 100/269 R |
| 1,721,421 | 7/1929 | Updegraff | 100/269 R |
| 2,075,968 | 4/1937 | Heydekampf | 100/214 X |
| 2,085,695 | 6/1937 | Dinzl | 100/269 R |
| 2,850,966 | 9/1958 | Dohm | 100/232 |

FOREIGN PATENT DOCUMENTS

| | | | |
|---|---|---|---|
| 940871 | 11/1963 | United Kingdom | 100/214 |

*Primary Examiner*—Billy J. Wilhite

*Attorney, Agent, or Firm*—Body, Vickers & Daniels

[57] ABSTRACT

The drive cylinder component of a hydraulic press is reciprocable relative to a fixed ram to drive the press slide toward the press bed for the performance of work on a workpiece between the slide and bed. The cylinder component is provided with an integral radially outwardly extending flange about the periphery thereof at the open end of the cylinder, and the press frame is provided with a stop plate surrounding the cylinder and disposed in the path of the flange so as to be engaged thereby as the cylinder approaches its lowermost position with respect to the press bed. The stop plate and flange are adapted to take a full press tonnage load. The flange also supports guide components engaging gibbing on the press frame for guidance and support of the cylinder and thus the slide during reciprocation thereof.

14 Claims, 7 Drawing Figures

FULL TONNAGE STOP FOR HYDRAULIC PRESSES

BACKGROUND OF THE INVENTION

This invention relates to the art of hydraulic presses and, more particularly, to an improved arrangement for positively stopping travel of the displaceable component of the hydraulic drive unit in the direction of movement thereof toward the press bed.

It is of course well known to provide a hydraulic press with a hydraulic drive unit of the character comprising a ram fixed with respect to the press frame and a cylinder slidably displaceable relative to the ram and operatively connected with the press slide to impart reciprocation thereto relative to the press bed. Heretofore, in connection with such a hydraulic drive unit in an overhead drive arrangement for example, the ram is fixed to the crown portion of the press frame, and the drive cylinder component has an open upper end receiving the ram and defines a hydraulic fluid receiving variable volume chamber with the ram. The press slide is attached to the closed lower end of the cylinder and is displaced thereby toward the press bed by introducing hydraulic fluid between the ram and cylinder. Return movement of the cylinder and slide is achieved by hydraulic return cylinder units on the crown and connected to the cylinder. Heretofore, the open upper end of the cylinder component has been provided with a crosshead mechanically fastened to the cylinder such as by bolts extending through the crosshead and axially into the cylinder wall. Piston rods of the return cylinders are attached to the crosshead, and radially outer portions of the crosshead carry guide components engageable with gibbing on the press frame to provide support and guidance for the cylinder during reciprocation thereof.

Work with respect to a given workpiece is of course performed during movement of the cylinder and thus the slide toward the press bed. The extent of displacement of the cylinder toward the press bed is critical with respect to protecting the drive cylinder, return cylinders and guide components from damage, and with respect to achieving a desired cooperable interengagement between tooling on the slide and press bed. In this respect, overtravel of the cylinder and thus the slide in the direction toward the press bed, such as might be due to a hydraulic malfunction for example, can result in damage to the mechanical connection between the crosshead and drive cylinder and, thus, to the guide components and gibbing and to the hydraulic return cylinder components. Accordingly, it is necessary to control and limit displacement of the drive cylinder and thus the slide in the direction toward the press bed to avoid such potential damage. Clearance requirements within the die space area of the press prevent the use of any mechanical stop pin or similar type arrangement between the slide and bed of the press and, heretofore, control of the displacement of the drive cylinder and thus the slide was achieved through the use of a hydraulic flow control valve mechanically actuated upon movement of the cylinder crosshead and thus the slide to a desired position relative to the press bed. In this respect, the valve is actuated to dump hydraulic fluid under pressure from behind the drive cylinder, thus to prevent slide overtravel. Such a dump valve arrangement is effective when it functions properly, but such an arrangement is unreliable in this respect and, moreover, is undesirably expensive. With regard in particular to unreliability, the valve as mentioned above is mechanically actuated by the crosshead component on the cylinder, whereby it is extremely difficult to maintain accuracy of adjustment between the valve actuator and crosshead to achieve valve operation at the same time during each succeeding stroke of the drive cylinder and thus the press slide. Accordingly, considerable down time is required to maintain a satisfactory degree of accuracy with respect to such valve actuation and, when such accuracy is lost, either slide undertravel or overtravel can result. Overtravel is undesirable for the reason of the potential damage referred to hereinabove, and undertravel can result in inaccuracies with respect to the work performed on a workpiece in the press.

SUMMARY OF THE INVENTION

In accordance with the present invention, an arrangement is provided for positively stopping and taking the full tonnage load of the hydraulic drive unit upon movement of the drive cylinder and thus the slide to the desired position relative to the press bed. More particularly, in this respect, the drive cylinder is provided with an integral radially outwardly extending flange about the periphery thereof, and the press frame is provided with a stop plate arrangement axially spaced from the die space area of the press and positioned in the path of movement of the flange so as to be engaged thereby when the drive cylinder and thus the slide reaches the desired position relative to the press bed. The flange and stop plate have sufficient structural integrity to take the full tonnage load for which the press and hydraulic drive unit are designed and, thus, positively stop the slide in the desired position eliminating the possibility of both undertravel and overtravel of the slide. Furthermore, such a positive stop arrangement advantageously eliminates potential mechanical damage to component parts of the return cylinder units, the gibbing, and the guide components associated with the flange of the drive cylinder. Still further, the arrangement according to the present invention advantageously eliminates the need for hydraulic fluid flow control through a mechanically or otherwise actuated dump valve, and provides continuity with respect to accuracy in controlling the position of the drive cylinder and thus the slide relative to the press bed.

It is accordingly an outstanding object of the present invention to provide an improved arrangement for controlling the displacement of the drive cylinder of a hydraulic drive unit for a press, and thus the press slide, relative to the press bed during the working stroke of the press.

A further object is the provision of a stop arrangement for the drive cylinder which minimizes wear and avoids structural damage to component parts of the hydraulic drive unit and guidance components associated therewith.

Another object is the provision of a positive, full tonnage stop arrangement for the drive cylinder in which the component parts of the stop arrangement are located outside the die space area of the press.

Yet another object is the provision of a stop arrangement of the foregoing character which positively prevents overtravel of the press slide toward the press bed.

Still a further object is the provision of a stop arrangement of the foregoing character enabling improved efficiency with respect to press operation and improved accuracy with respect to work performed on workpieces in the press.

Yet another object is the provision of a stop arrangement of the foregoing character which is more economical to construct, use and maintain than stop arrangements heretofore employed and which at the same time provides improved accuracy with respect to continuously stopping the press slide in a desired position relative to the press bed during the working stroke of the press.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawings in which.

DESCRIPTION OF A PREFERRED EMBODIMENT

Figure 1:
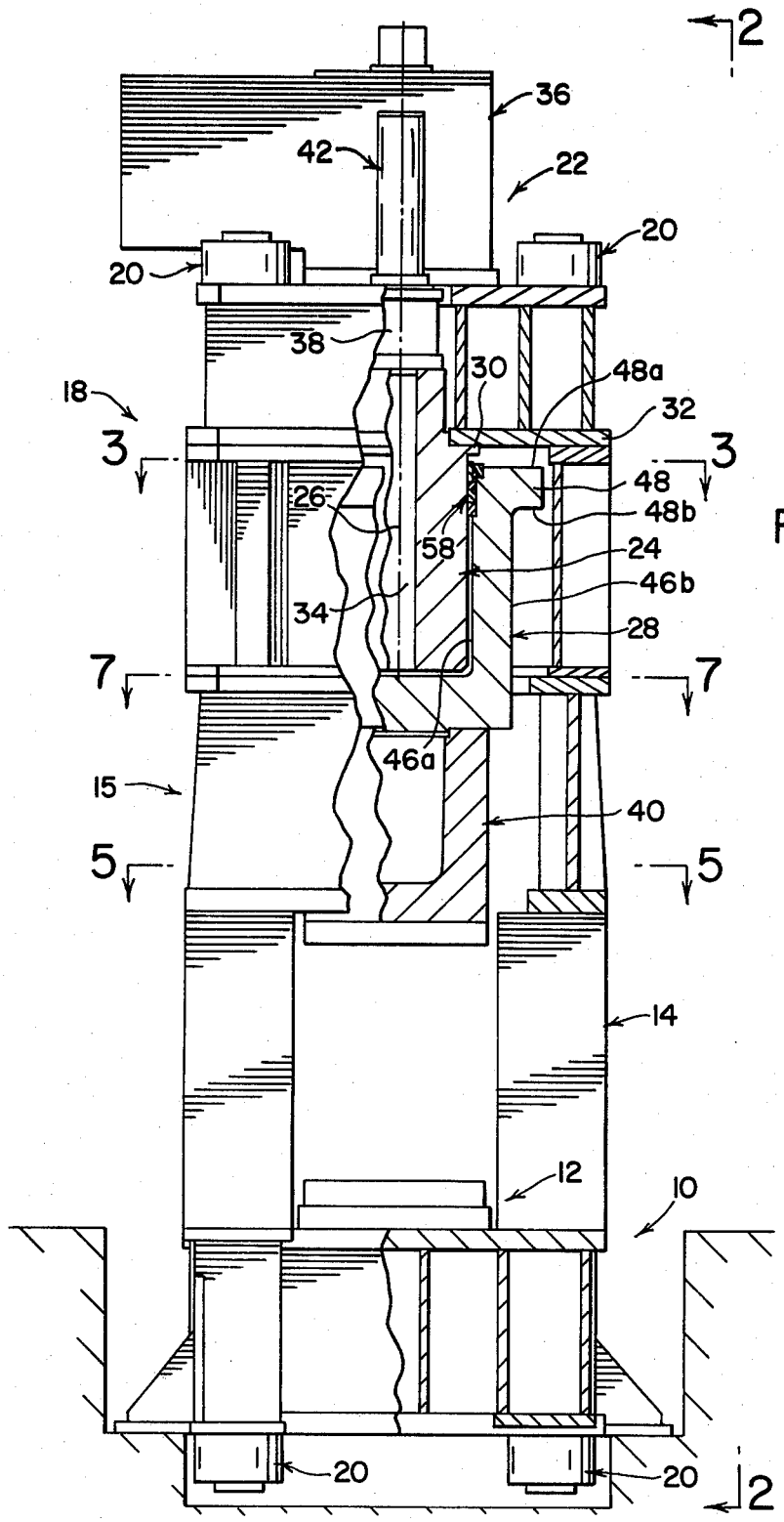
FIG. 1 is a front elevation view, partially in section, of a hydraulic press incorporating the stop arrangement according to the present invention.
Figure 2:
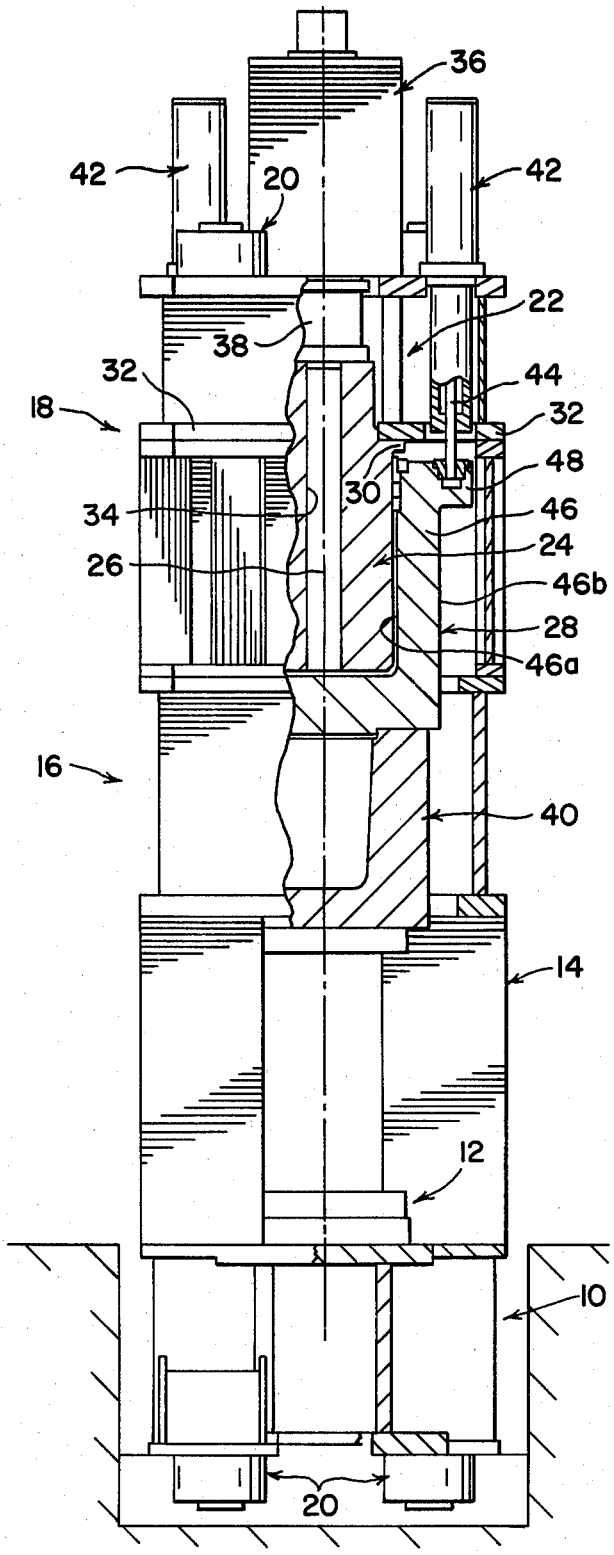
FIG. 2 is a side elevation view, partially in section, of the press as seen in the direction of line 2—2 in FIG. 1.

Referring now in greater detail to the drawings wherein the showings are for the purpose of illustrating a preferred embodiment of the invention only and not for the purpose of limiting the invention, a hydraulic forging press is illustrated in FIGS. 1 and 2 of the drawing comprising a frame assembly including a lower portion 10 providing a bed area 12 at about floor level, corner post portion 14, an intermediate frame portion 16, and a crown portion 18. The latter frame portions are of welded construction and are interengaged in assembled relationship by means of tie rod units 20 at the four corners of the press. The hydraulic drive unit for the press is designated generally by the numeral 22 and includes a ram member 24 having a vertical axis 26, and a drive cylinder 28 received on and reciprocable relative to ram 24 as set forth more fully herinafter. Ram 24 has a radially outwardly extending peripheral flange 30 intermediate the opposite ends thereof and by which the ram is mounted such as by bolting to a frame plate 32 in crown portion 18, and the ram has a central passageway 34 communicating at its upper end with a source 36 of hydraulic fluid under pressure through a coupling 38 therebetween. The lower end of cylinder 28 is closed, thus to provide a variable volume hydraulic fluid receiving chamber with ram 24 and, in the embodiment illustrated, a slide member 40 is suitably attached to the closed lower end of cylinder 28 and thus is displaceable therewith relative to ram 24 during operation of the press. It will be appreciated, of course, that the lower end of slide member 40 and bed 12 of the press are adapted to receive and support corresponding tooling by which work is performed on a workpiece interposed therebetween during displacement of the slide toward and away from bed 12. As is well known, hydraulic fluid under pressure is adapted to flow from source 36 through ram passageway 34 through the use of suitable controls, not illustrated, to achieve displacement of cylinder 28 and thus slide member 40 downwardly toward bed 12. In the embodiment illustrated, upward or return movement of cylinder 28 and slide member 40 is achieved by means of a pair of hydraulic return cylinder units 42 mounted in the crown portion of the press and having corresponding piston rods 44 interengaged with the upper end of cylinder 28 as set forth more fully hereinafter. As is well known, fluid flow to such return cylinder units is through suitable controls, not illustrated, which provide for piston rods 44 to descend freely with drive cylinder 28 until the slide reaches its lowermost position, at which time hydraulic fluid under pressure is introduced into cylinder units 42 to elevate cylinder 28 and thus slide 40. Such return movement of the slide is of course enabled by releasing hydraulic fluid under pressure between ram 24 and drive cylinder 28 for free flow through passageway 34 back to source 36.

Figure 3:
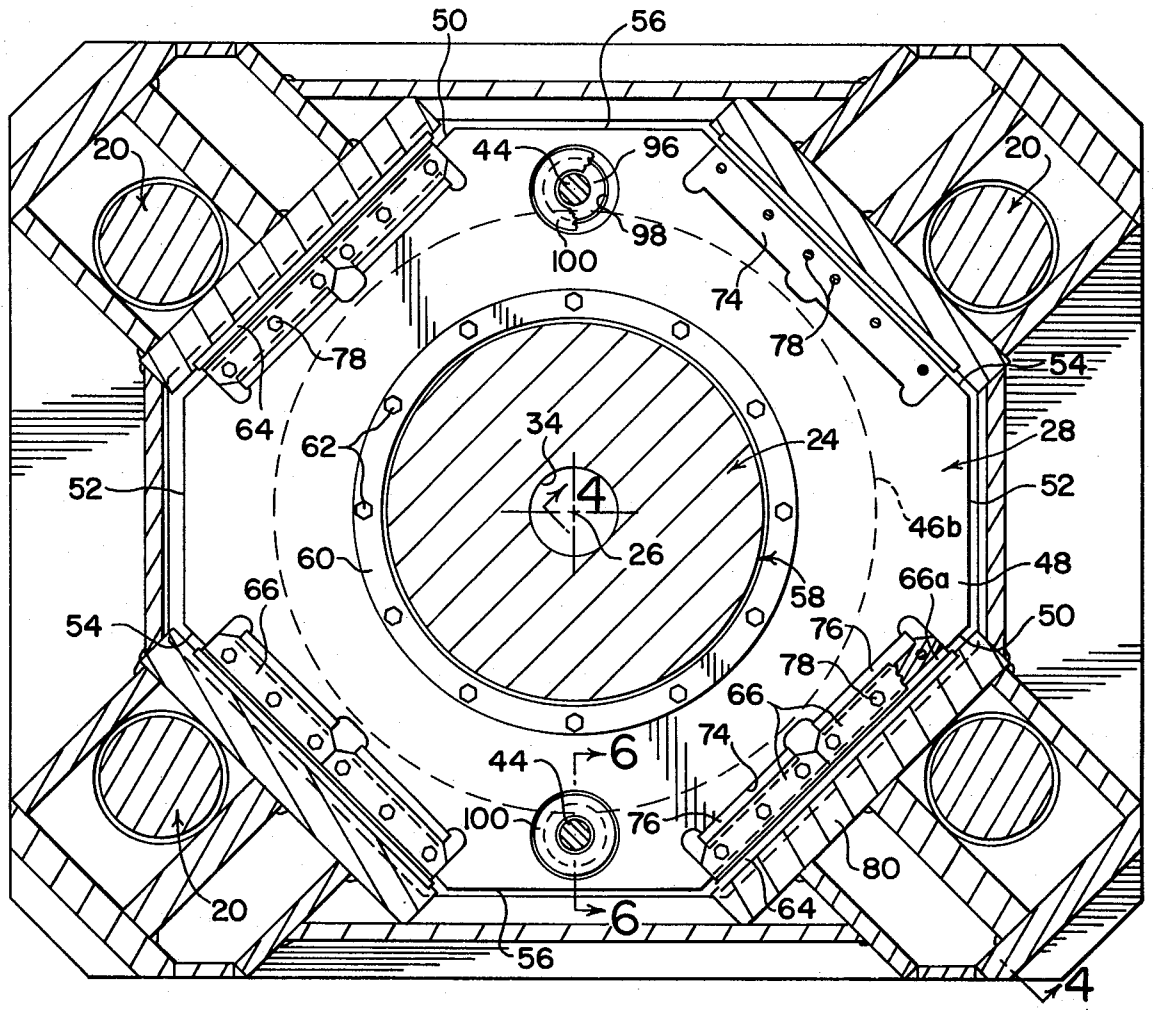
FIG. 3 is a plan view, in section, taken along line 3—3 in FIG. 1 and showing the flange at the upper end of the drive cylinder.
Figure 4:
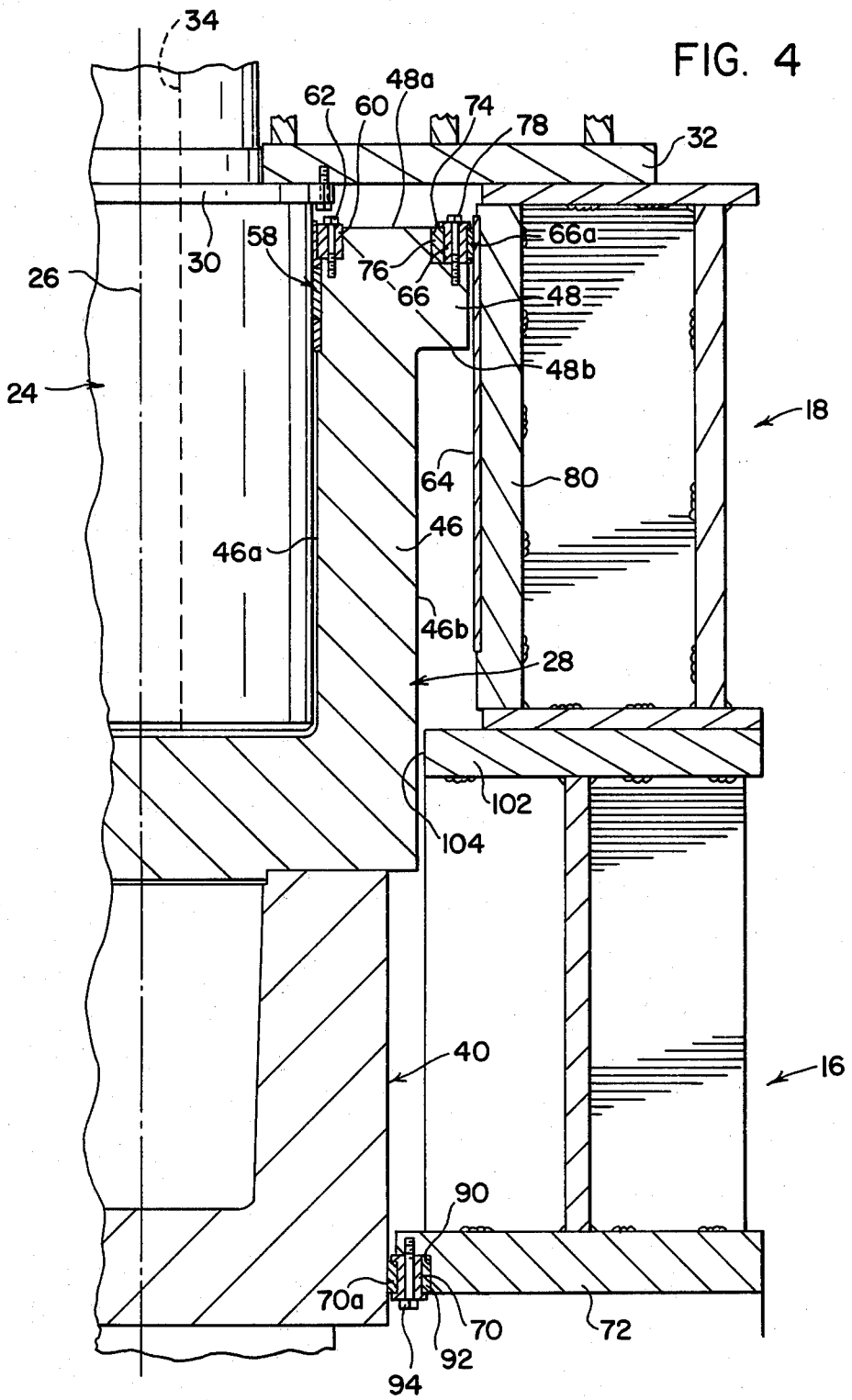
FIG. 4 is a detailed sectional elevation view taken along line 4—4 in FIG. 3 and showing the upper and lower gibbing arrangement for the drive cylinder and slide.

In accordance with the present invention, and as will be best appreciated from FIGS. 1–4 of the drawing, drive cylinder 28 includes a circular body portion 46 having radially inner and outer surfaces 46*a* and 46*b*, respectively, and a radially outwardly extending flange 48 integral with the body portion at the open upper end of the cylinder and extending about the periphery thereof. In the embodiment illustrated, flange 48 is octagonal in plan view and has radially extending upper and lower sides 48*a* and 48*b*, respectively. As will be seen in FIG. 3, the octagonal configuration of flange 48 provides the flange with diametrically opposed pairs of radially outer sides 50, 52, 54 and 56. The sides of each pair are planar and parallel to one another and extend axially between the upper and lower sides of flange 48. As seen in FIGS. 3 and 4, the open upper end of drive cylinder 28 is slidably and sealingly interengaged with ram 24 by means of an annular sealing ring assembly 58 received in an annular recess therefor on inner surface 46*a* of the cylinder and retained in place by means of an annular retaining ring 60 secured to cylinder 28 by means of a plurality of bolts 62.

Figure 5:
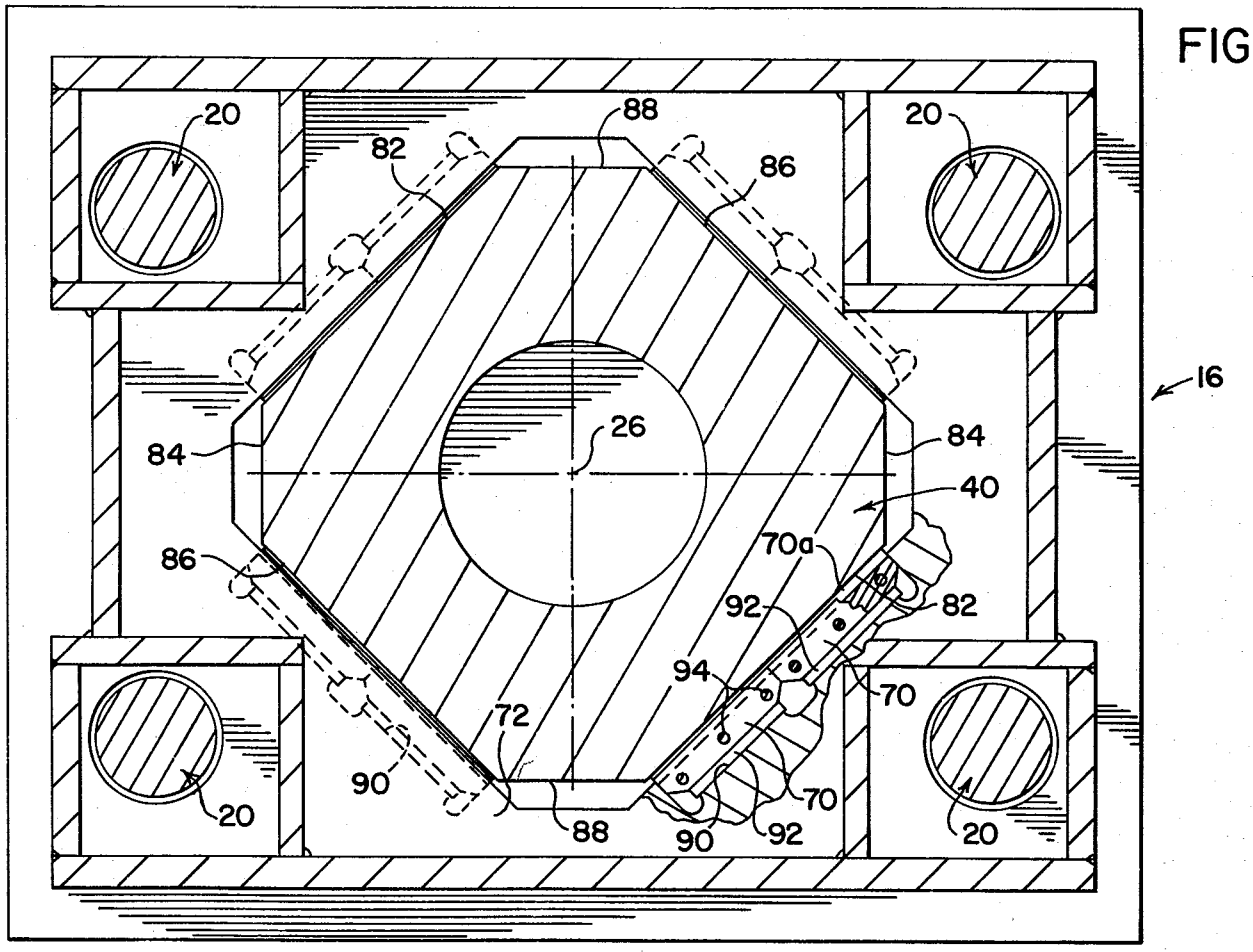
FIG. 5 is a plan view, in section, taken along line 5—5 in FIG. 1 and showing the lower guidance arrangement for the drive cylinder and slide.

As further seen in FIGS. 3–5, guidance for drive cylinder 28 and slide member 40 during reciprocation thereof is provided at the upper end of cylinder 28 by gibbing 64 on crown portion 18 of the frame and corresponding guide blocks 66 on flange 48, and at the lower end of the cylinder and slide assembly by means of guide blocks 70 mounted on the underside of a frame plate 72 at the lower end of intermediate portion 16 of the press frame. More particularly with regard to the upper gibbing and guide block arrangements, flange 48 of drive cylinder 28 is provided adjacent each of the pairs of sides 50 and 54 with an axially and radially extending recess 74 parallel to the corresponding radially outer side. Each recess 74 receives a pair of guide blocks 66 and corresponding shims 76, which guide blocks and shims are secured in recess 74 by means of a plurality of bolts 78. Each guide block 66 carries a corresponding wear plate 66a. Gibbing 64 for each guide block assembly is mounted on a corresponding gibbing support frame plate 80 in crown portion 18 of the press frame, and it will be appreciated of course that wear plates 66a on guide blocks 66 slidably engage the corresponding gibbing to provide lateral support and vertical guidance for drive cylinder 28 and slide member 40 during reciprocation thereof.

With regard to support and guidance at the lower end of the drive cylinder and slide assembly, it will be seen from FIGS. 4 and 5 of the drawing that the outer surface of slide member 40 is octagonal in cross-sectional configuration providing opposed pairs of parallel, axially extending planar surfaces 82, 84, 86 and 88 corresponding, respectively, to sides 50, 52, 54 and 56 of drive cylinder flange 48. As mentioned hereinabove, guidance at the lower end is provided by guide blocks 70 mounted on frame plate 72 and, more particularly in this respect, frame plate 72 provides an octagonal opening defined by sides facing and parallel to sides 82, 84, 86 and 88 of slide member 40. The bottom of frame plate 72 is provided with axially and radially extending recesses 90 along each of the opposed pairs of the edges of the opening therethrough corresponding to sides 82 and 86 of slide member 40. Each recess 90 receives a pair of guide blocks 70 and corresponding shims 92, which guide blocks and shims are retained in place in the corresponding recess by means of a plurality of bolts 94. Each guide block 70 carries a wear plate 70a slidably engaging the corresponding one of the guides 82 and 86 of slide member 40.

Figure 6:
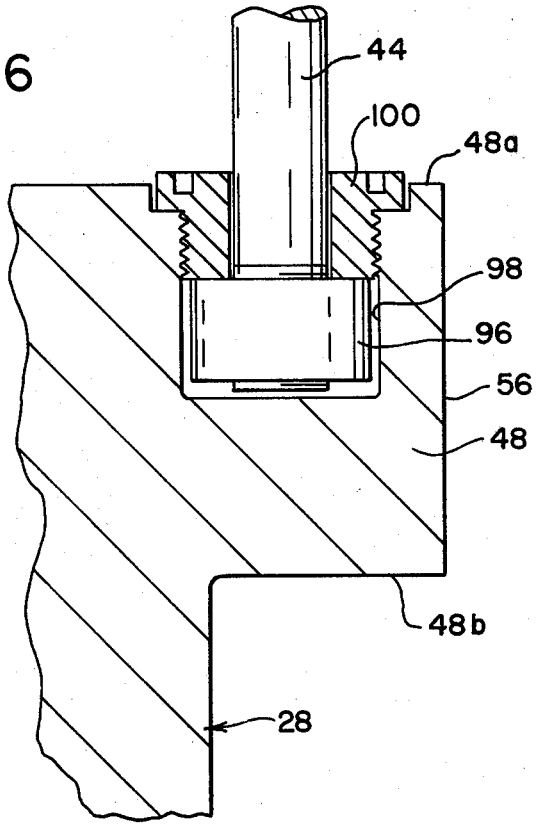
FIG. 6 is a detailed sectional elevation view taken along line 6—6 in FIG. 3 and showing the return cylinder piston rod connection to the flange of the drive cylinder; and, FIG. 7 is a plan view, in section, taken along line 7—7 in FIG. 1 and showing the stop plate for the drive cylinder.

As mentioned hereinabove, upward or return movement of drive cylinder 28 and slide member 40 is achieved by hydraulic return cylinder units 42 having piston rods 44 fastened to drive cylinder flange 48. As will be seen in FIGS. 3 and 6 of the drawing, piston rods 44 of the hydraulic return cylinders are connected to flange 48 of the drive cylinder radially inwardly adjacent the diametrically opposite sides 56 thereof. More particularly in this respect, the lower end of each piston rod is provided with a head 96 received in a bore 98 extending axially into flange 48 from upper side 48a thereof, and head 96 and thus piston rod 44 is releaseably connected to flange 48 by means of a retaining collar 100 threadedly interengaged with recess 98.

Figure 7:
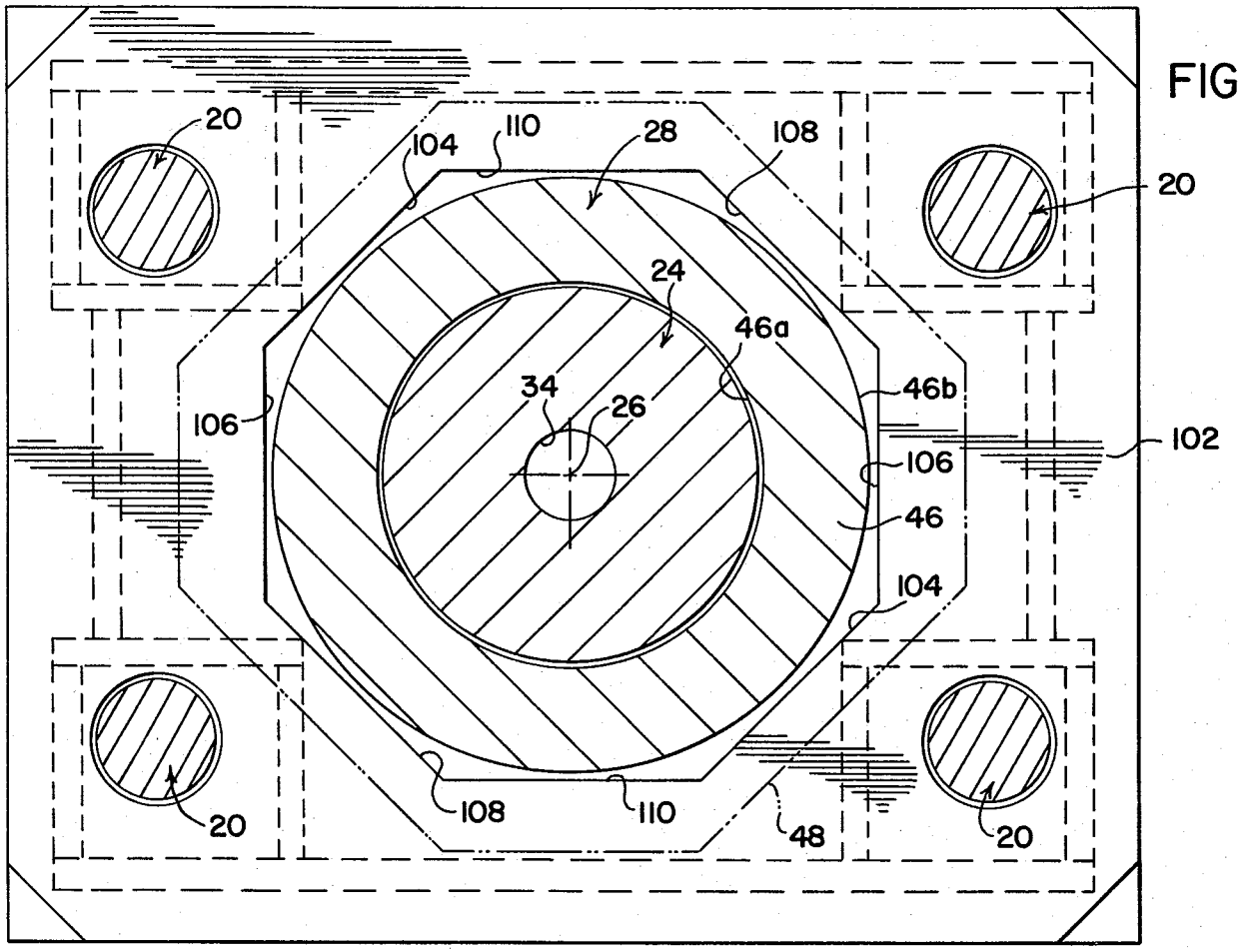

It will be appreciated from the description thus far that the introduction of hydraulic fluid under pressure between ram 24 and drive cylinder 28 from source 36 displaces cylinder 28 and thus slide member 40 downwardly toward press bed 12 for tooling on the latter and slide member 40 to perform work on a workpiece interposed therebetween. Following the downward stroke of the drive cylinder, hydraulic return cylinders 42 are actuated to return the drive cylinder and thus slide member 40 to their uppermost positions to complete a cycle of press operation. Further in accordance with the present invention, a positive stop arrangement is provided on the press frame for engagement with drive cylinder flange 48 to limit downward movement of the drive cylinder and thus slide 40 relative to the press bed, thus to positively prevent overtravel of the slide. More particularly in this respect, and as will be seen in FIGS. 3, 4 and 7 of the drawing, the press frame includes a stop plate 102 between intermediate portion 16 and crown portion 18 of the frame. Stop plate 102 extends about circular body portion 46 of drive cylinder 28 and is provided with an octagonal opening therethrough providing diametrically opposed pairs of parallel planar walls 104, 106, 108 and 110 corresponding, respectively, with radially outer sides 50, 52, 54 and 56 of drive cylinder flange 48. Walls 104, 106, 108 and 110 are disposed in close proximity to the outer surface of body portion 46 of the drive cylinder, whereby the portions of plate 102 radially outwardly adjacent each of the walls 104, 106, 108 and 110 underlie and are in the path of movement of the corresponding portion of drive cylinder flange 48. It will be appreciated that when drive cylinder 28 is in its uppermost position relative to ram 24, the upper surface of stop plate 102 is axially spaced from the underside of flange 48 a distance corresponding to the desired stroke of the drive piston and thus the press slide. Upon engagement of the underside of flange 48 with stop plate 102, the drive cylinder is positively stopped to prevent overtravel, and the flange has sufficient structural strength to take the full tonnage load for a given press. Accordingly, there are no variations in the displacement characteristics of the slide as it approaches bottom dead center which can effect the quality of the work being done on a workpiece in the press.

While particular emphasis has been placed herein on the specific structure and structural interrelationship between the component parts in the preferred embodiment of the invention, it will be appreciated that many embodiments of the invention can be made and that many changes can be made in the preferred embodiment without departing from the principles of the present invention. It is essential in accordance with the present invention that the flange on the drive cylinder be integral with the body portion thereof. However, the flange may have an outer peripheral configuration other than octagonal, and gibbing and guide arrangements other than those illustrated and described in connection with the preferred embodiment can be employed. Moreover, other frame designs and constructions can readily be devised to provide a positive stop arrangement supported by the press framing for engagement with the drive cylinder flange, it only being necessary that the positive stop components be supported on the press frame and outside the die space area of the press. These and other modifications will be suggested and obvious to those skilled in the art upon reading the description of the preferred embodiment and, accordingly, it is to be distinctly understood that the foregoing descriptive matter is to be interpreted merely as illustrative of the present invention and not as a limitation.

Having thus described the invention, it is claimed:

1. In a hydraulic press comprising frame means providing fixed tool support means, slide means reciprocable toward and away from said tool support means along an axis and through a total stroke including a work stroke having an end and during which work stroke a working force is imposed on a workpiece between said slide means and tool support means, and hydraulic drive means for reciprocating said slide means and providing said working force against said workpiece during said work stroke, said drive means including ram means fixed on said frame means coaxial with said axis and hydraulic cylinder means received on said ram means and reciprocable relative thereto toward and away from said tool support means, the improvement comprising: said cylinder means including radially outwardly extending flange means integral therewith, and stop means on said frame means in the path of said flange means to stop displacement of said cylinder means in the direction toward said tool support means at said end of said work stroke.

2. A hydraulic press according to claim 1, wherein said cylinder means has axially opposite ends and said flange means is at the one of said ends farthest from said tool support means.

3. A hydraulic press according to claim 1, wherein said cylinder means includes a circular body portion and said flange means has a non-circular contour transverse to said axis and providing diametrically opposed flange portions for engaging said stop means.

4. A hydraulic press according to claim 1, wherein said stop means includes stop plate means on said frame means transverse to said axis and extending about said cylinder means.

5. A hydraulic press according to claim 1, wherein said flange means has axially opposite sides, one of said sides facing said stop means, axially extending gibbing means on said frame means, and guide means on the other of said sides of said flange means slidably engaging said gibbing means during reciprocation of said cylinder means.

6. A hydraulic press according to claim 5, wherein said cylinder means has axially opposite ends and said flange means is at the one of said ends farthest from said tool support means.

7. A hydraulic press according to claim 6, wherein said cylinder means includes a circular body portion and said flange means has a non-circular contour transverse to said axis and providing diametrically opposed flange portions for engaging said stop means.

8. A hydraulic press according to claim 7, wherein said stop means includes stop plate means on said frame means transverse to said axis and extending about said cylinder means.

9. A hydraulic press according to claim 5, wherein said flange means includes diametrically opposite flange portions, said guide means including guide member means on each said flange portion, and said gibbing means including corresponding gibbing member means for each guide member means.

10. A hydraulic press according to claim 9, wherein each said flange portion has an axially planar radially outer side intersecting said axially opposite sides of said flange means.

11. A hydraulic press according to claim 10, wherein said stop means includes stop plate means on said frame means transverse to said axis and extending about said cylinder means.

12. A hydraulic press according to claim 11, wherein said cylinder means has axially opposite ends and said flange means is at the one of said ends farthest from said tool support means.

13. A hydraulic press according to claim 12, wherein said cylinder means includes a circular body portion, and said flange means is of polygonal contour transverse to said axis.

14. A hydraulic press according to claim 13, wherein said stop plate means extends about said circular body portion and has an opening therethrough dimensionally smaller and corresponding in contour to said contour of said flange means.

* * * * *